US005384925A

United States Patent [19]

Vail

[11] Patent Number: 5,384,925

[45] Date of Patent: Jan. 31, 1995

[54] BED ENCLOSURE

[76] Inventor: Robert L. Vail, 6213 Cedar Point Rd., Oregon, Ohio 43618

[21] Appl. No.: 100,477

[22] Filed: Jul. 30, 1993

[51] Int. Cl.[6] ..... A47C 21/08

[52] U.S. Cl. ..... 5/424; 5/414; 5/310; 5/97; 5/507.1

[58] Field of Search ..... 5/97, 310, 414, 424, 5/507.1, 658

[56] References Cited

U.S. PATENT DOCUMENTS

| | | | |
|---|---|---|---|
| 875,206 | 12/1907 | Osborne | 5/414 |
| 2,490,956 | 12/1949 | Freund | 5/310 X |
| 2,682,671 | 7/1954 | Faure | 5/507.1 |
| 2,941,215 | 6/1960 | Johnson | 5/507.1 |
| 4,017,917 | 4/1977 | Brown | 5/414 X |
| 4,641,387 | 2/1987 | Bondy et al. | 5/658 |
| 4,959,878 | 10/1990 | Essek | 5/424 |

FOREIGN PATENT DOCUMENTS

| | | | |
|---|---|---|---|
| 843310 | 8/1960 | United Kingdom | 5/507.1 |

*Primary Examiner*—Michael F. Trettel
*Attorney, Agent, or Firm*—MacMillan, Sobanski & Todd

[57] ABSTRACT

An improved bed enclosure is provided with an unique supporting structure which increases the vertical stability of the bed enclosure. The bed enclosure includes a frame having at least four upright side posts, each including an upper portion and a lower portion. The frame further includes upper frame support members interconnecting the upper portions of the side posts together, and lower frame support members interconnecting the lower portions of the side posts together. The frame defines a pair of generally vertical side walls of a predetermined length and a pair of opposed end walls of a predetermined width, the predetermined length being greater than the predetermined width. In accordance with one embodiment of the present invention, at least one support leg is associated with each of the side walls and is secured to the lower portions of the side posts and is engageable with the floor at a point spaced outwardly from the respective side wall. In accordance with another embodiment of the present invention, at least one support leg is associated with each of the side walls and is secured to the lower frame support members and is engageable with the floor at a point spaced outwardly from the respective side wall.

2 Claims, 2 Drawing Sheets

BED ENCLOSURE

BACKGROUND OF THE INVENTION

This invention relates to a bed enclosure for restraining a patient.

In some medical treatment situations, it is sometimes necessary (or preferred) to restrain certain patients in order to provide protection for themselves and/or others. For example, adults and children having dementia, psychiatric or mental disorders, or other kinds of mental and/or physical problems may need to be restrained. In the past, these people have been physically restrained by using ties, straps, or vests. However, the use of these kinds of restraints can cause physical and psychological harm, can cause severe discomfort and can impede emergency treatment. In addition, these kinds of restraints must frequently be removed during the day for a variety of reasons, such as to allow the person to exercise his or her muscles, or to clean or feed the person.

One highly preferred alternative to using physical restraints involves using a bed enclosure. One kind of bed enclosure is disclosed in U.S. Pat. No. 4,641,387 to Bondy et al. As shown in this patent, the bed enclosure includes a supporting framework and a netted covering which is fitted over the sides and top of the framework. The netted covering is provided with zippered areas which can be readily opened and closed in order to provide access to the interior of the enclosure. Thus, the bed enclosure provides a more humane, safe, and less restrictive environment for the person.

SUMMARY OF THE INVENTION

The length and width of a bed enclosure, such as that disclosed in the above referenced Bondy et al. patent, is generally the same size as the size of the mattress. Also, in order to allow a patient to have some room for movement in the enclosure, the enclosure can extend vertically to a height of around 6 feet. Applicant has discovered that as a result of the ratio of the width to the height of the enclosure, a patient inside can rock or sway the enclosure and may even possibly cause the enclosure to overturn.

This invention relates to an improved bed enclosure which includes support legs or stabilizing means for minimizing the possibility of overturning the enclosure by a person inside. The bed enclosure includes a frame having at least four upright side posts, each including an upper portion and a lower portion. The frame further includes upper frame support members interconnecting the upper portions of the side posts together, and lower frame support members interconnecting the lower portions of the side posts together. The frame defines a pair of generally vertical side walls of a predetermined length and a pair of opposed end walls of a predetermined width, the predetermined length being greater than the predetermined width. In accordance with one embodiment of the present invention, at least one support leg is associated with each of the side walls and is secured to the lower portions of the side posts and is engageable with the floor at a point spaced outwardly from the respective side wall to thereby increase the vertical stability of the bed enclosure. In accordance with another embodiment of the present invention, at least one support leg is associated with each of the side walls and is secured to the lower frame support members and is engageable with the floor at a point spaced outwardly from the respective side wall to thereby increase the vertical stability of the bed enclosure.

As a result of the support legs of the present invention, the possibility of a person inside the bed enclosure overturning the enclosure is minimized.

Other advantages of this invention will become apparent to those skilled in the art from the following detailed description of the preferred embodiment, when read in light of the accompanying drawing.

DETAILED DESCRIPTION OF THE PREFERRED EMBODIMENT

Figure 1:
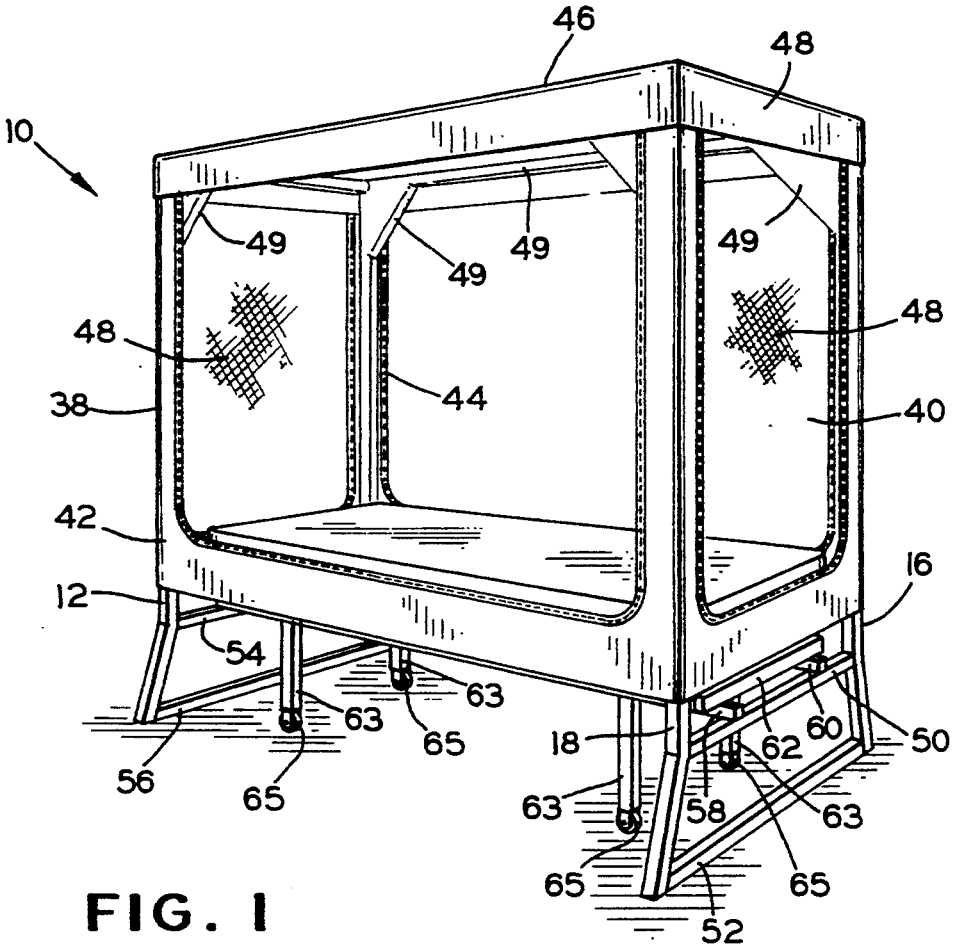
FIG. 1 a perspective view of a first embodiment of a bed enclosure constructed in accordance with the present invention.

Referring now to the drawings, there is illustrated in FIG. 1 a bed enclosure, indicated generally at 10, and constructed in accordance with the present invention. As shown therein, the bed enclosure 10 comprises a generally rectangularly shaped frame (best shown in FIG. 3) which includes four upright side posts 12, 14, 16, and 18, and four upper members 20, 22, 24, and 26 connected thereto. In addition, the frame includes angled brackets 28, 30, 32, and 34. Preferably, the brackets 28, 30, 32, and 34 include a pair of flats 36 on the ends thereof, and apertures are drilled through the flats and the side posts 12, 14, 16, and 18, and the upper members 20, 22, 24, and 26, so that the brackets can be bolted to the side posts and the upper members.

The frame defines a pair of opposed ends 38 and 40, a pair of opposed sides 42 and 44, and a top 46. As shown in FIG. 1, the sides 42 and 44, the ends 38 and 40, and the top 46 of the frame 10 are covered by netting 48, and the netting on the sides 42 and 44 and the ends 38 and 40 includes zippered access openings. Also, the side posts 12, 14, 16, and 18, and the angled brackets 28, 30, 32, and 34 are covered by padding 49. In addition, a removable upper cover 48 is placed around the upper portion of the frame 10, and a lower cover (not shown) is placed around the lower portion of the frame 10.

The particular embodiment of the frame 10 shown in FIG. 1 further includes two sets of lower end rails 50 and 52, and 54 and 56, and a pair of lower side rails 58 and 60. The lower side rails 58 and 60 are secured to the lower ends rails 50 and 54. The side rails 58 and 60 are used to secure a bed 62 to the frame, and a mattress 64 rests upon the bed 62.

The bed 62 further includes four adjustable legs 63 having casters 65 secured to the ends thereof. The legs 63 are adjustable between an extended position, as shown in FIG. 1, and a retracted position (not shown) to allow the bed enclosure to be easily moved. Preferably, the frame 10 is constructed of square aluminum bars, and the end rails 50, 52, 54, and 56 are secured to the side posts 12, 14, 16, and 18 by welding, the side rails 58 and 60 are secured to the end rails 50 and 54 by welding, and the bed 62 is bolted to the side rails 58 and 60.

Figure 2:
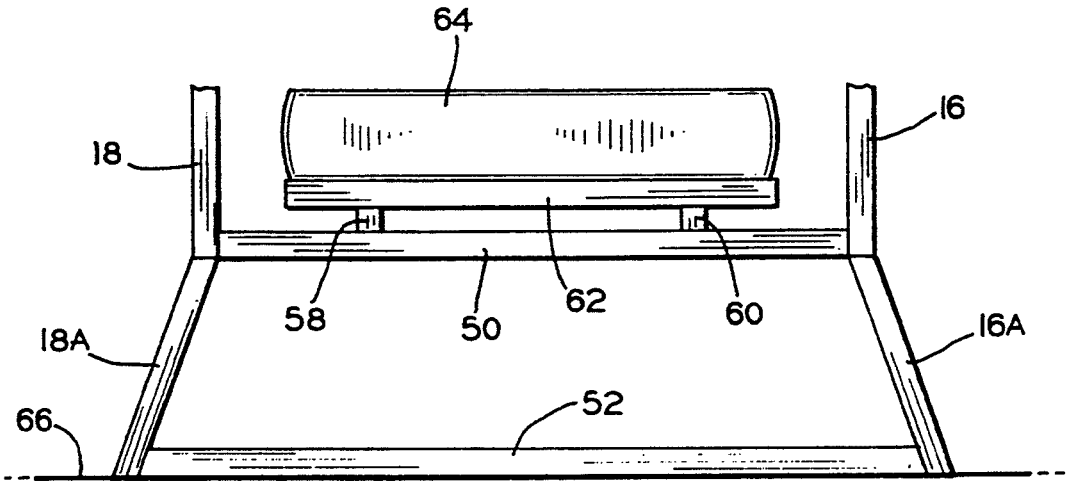
FIG. 2 is a partial end view of the bed enclosure shown in FIG. 1, and showing the stabilizing means of the first embodiment.

Turning now to FIG. 2, there is illustrated a partial elevational end view of the bed enclosure 10 shown in FIG. 1. As shown therein, the lower ends of the side posts 12, 14, 16, and 18 include lower sections 12A, 14A, 16A, and 18A respectively, which are flared outwardly and downwardly relative to the remainder of the posts. The lower flared outwardly extending sections 12A, 14A, 16A, and 18A define legs which are adapted to engage and support the bed enclosure on a resting surface 66, such as a floor. As will be discussed below, these flared out portions provide the bed enclosure with support legs or stabilizing means which minimizes the possibility of the enclosure from being tipped or rolled over by a person within the enclosure.

In addition, as shown in this embodiment, the end rails 52 and 56 are secured near the bottom of the sections 2A, 14A, 16A, and 18A so that a lower side surface thereof also engages and supports the bed enclosure 10 on the floor 66. Preferably, the sections 12A, 14A, 16A, and 18A are flared outwardly at an angle of approximately 30°.

Figure 3:
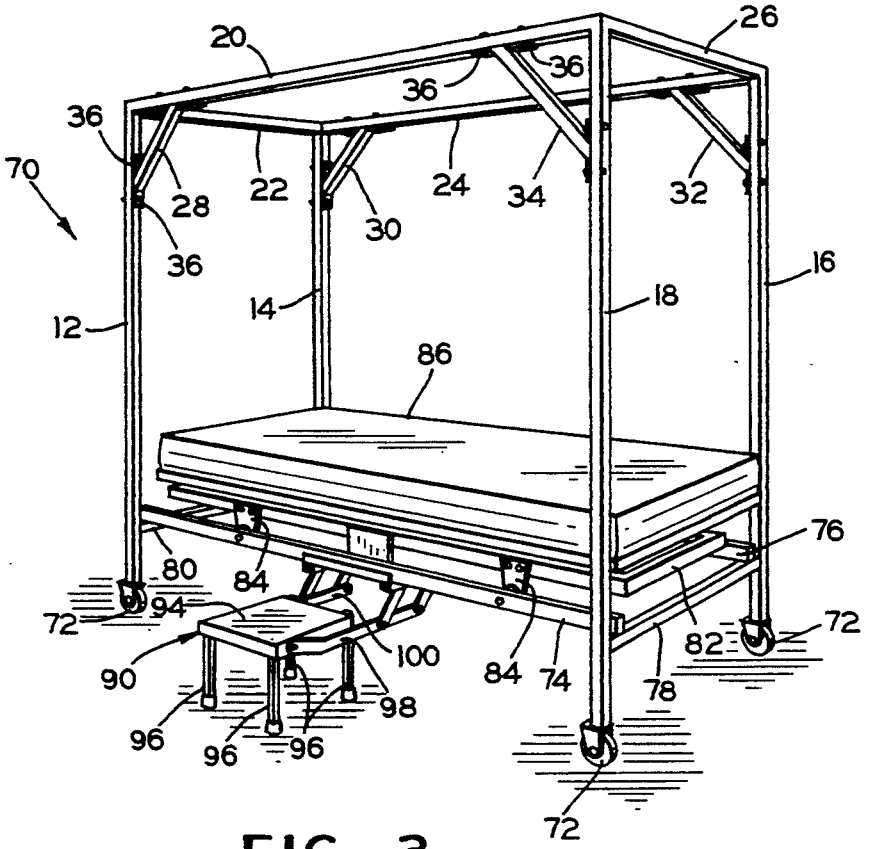
FIG. 3 is a perspective view of another embodiment of a bed enclosure constructed in accordance with the present invention.

FIG. 3 illustrates another embodiment of a bed enclosure, indicated generally at 70, which is similar to the bed enclosure 10 shown in FIG. 1, except that the lower portions of the side posts 12, 14, 16, and 18 are not flared outwardly, and casters 72 are attached to the lower ends of each of the side posts.

The bed enclosure 70 shown in this embodiment further includes a pair of side rails 74 and 76, and a pair of end rails 78 and 80. Preferably, the bed enclosure is constructed of aluminum square and the end rails 78 and 80 are secured to the side posts by welding, and the side rails 74 and 76 are bolted to the end rails 78 and 80. A bed 82 is secured to the side rails 74 and 76 by a pair of brackets 84 bolted to each side of the bed 82 and the rails 74. A mattress 86 rests upon the bed 82.

Figure 4:
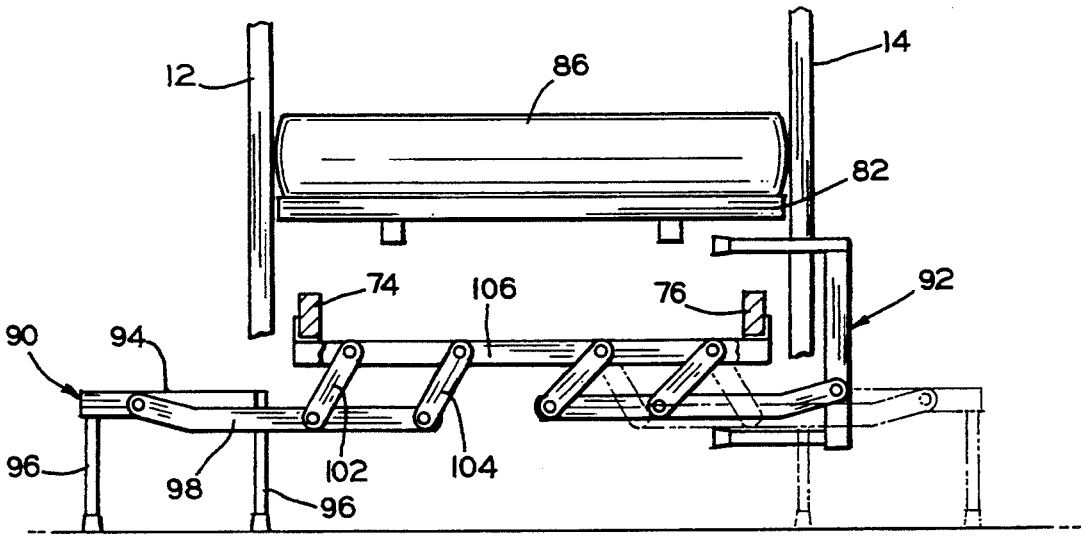
FIG. 4 is a partial sectional view of a portion of the bed enclosure shown in FIG. 3, and showing the stabilizing means of the second embodiment.

Turning now to FIG. 4, there is illustrated a partial elevational end view of the bed enclosure 70 shown in FIG. 3. As shown therein, the bed enclosure 70 in this embodiment includes a pair of support legs or stabilizing means 90 and 92 which are movable from a retracted/inoperative position shown on the right hand side of FIG. 4, to an extended/operative position shown on the left hand side of FIG. 4. The extended position of the stabilizing means on the right hand side of FIG. 4 is also illustrated in phantom. As will be discussed below, when the stabilizing means 90 and 92 are in their extended positions they are operative to minimize the possibility of the bed enclosure 70 from being tipped or rolled over by a person within the bed enclosure.

As best shown in FIG. 4, each stabilizing means includes a generally square step or platform 94 having a leg 96 in each corner thereof. Each step 94 is pivotally connected to a pair of arms 98 and 100. Each of the arms 98 and 100 is pivotally connected to a pair of links 102 and 104 which in turn, are pivotally connected to a support member 106. The support member 106 is secured to a lower surface of a generally L-shaped mounting bracket 108. The mounting bracket 108 is secured to the side rails 74 and 76 of the bed frame. Preferably, the components of the stabilizing means 90 and 92 are constructed of aluminum. Also, the support member 106 is preferably secured to the mounting bracket 108 by welding, and the mounting bracket 108 is secured to the side rails 74 and 76 by welding.

One advantage of the present invention is that the stabilizing means (12A, 14A, 16A, and 18A in FIG. 1, and 90 and 92 in FIG. 3), increases the stability of the bed enclosure (10 and 70, respectively), thereby minimizing the possibility of the enclosure from being tipped or rolled over by a person inside. In addition, the stabilizing means 90 and 92 also provides an intermediate step up into or down from the bed making access into or out of the bed enclosure more easy. Also, the stabilizing means 90 and 92 easily folds to the retracted/inoperative position to enable the bed enclosure 70 to be freely moved through most doorways.

While the invention has been described and illustrated as being applicable to a bed enclosure which includes a bed as an integral part thereof, the invention can also be used in enclosures of the type disclosed in the above referenced Bondy et al. patent which do not include a bed as an integral part thereof. In addition, while the invention has been described and illustrated as disclosing two specific examples of support legs or stabilizing means, other structures for increasing the vertical stability of the bed enclosure can be used. For example, the lower portions of the side posts can continue straight down to the floor, and support legs (not shown) can be secured to the lower portions of the side posts which extend outwardly therefrom and engage the floor at a point spaced outwardly therefrom.

In accordance with the provisions of the patent statutes, the principle and mode of operation of this invention have been described and illustrated in its preferred embodiment. However, it must be understood that the invention may be practiced otherwise than as specifically explained and illustrated without departing from its spirit or scope of the attached claims.

What is claimed:

1. A bed enclosure comprising:

a frame including at least four upright side posts each including an upper portion and a lower portion, upper frame support members interconnecting said upper portions of said side posts together, lower frame support members interconnecting said lower portions of said side posts together, said frame defining a pair of generally vertical side walls of a predetermined length and a pair of opposed end walls of a predetermined width, said predetermined length being greater than said predetermined width; and said lower portion of at least one of said side posts associated with each of said side walls is angled outwardly relative to said associated side wall and engageable with the floor at a point spaced outwardly from said associated side wall to thereby increase the vertical stability of the bed enclosure.

2. The bed enclosure defined in claim 1 wherein said lower portions of each of said side posts is angled outwardly relative to said associated side wall and further including a pair of end wall support rails secured to said lower portions of said side posts, each of said end wall support rails extending beyond said ends walls and having a lower surface engageable with the floor to thereby further increase the vertical stability of the bed enclosure.

* * * * *